US005613172A

United States Patent [19]

Pietrowski et al.

[11] Patent Number: 5,613,172

[45] Date of Patent: Mar. 18, 1997

[54] HYBRID DC RECHARGE METHOD AND APPARATUS FOR SPLIT RECHARGE IMAGING

[75] Inventors: Kenneth W. Pietrowski, Penfield; Thomas J. Fleck, Webster, both of N.Y.

[73] Assignee: Xerox Corporation, Stamford, Conn.

[21] Appl. No.: 519,872

[22] Filed: Aug. 25, 1995

[51] Int. Cl.[6] ..... G03G 15/02

[52] U.S. Cl. ..... 399/50; 250/324; 361/225; 399/170; 399/173

[58] Field of Search ..... 399/50, 170–173, 399/231, 296; 250/324–326; 361/220, 225, 230

[56] References Cited

U.S. PATENT DOCUMENTS

| | | | |
|---|---|---|---|
| 5,008,707 | 4/1991 | Ewing et al. | 355/220 |
| 5,426,487 | 6/1995 | Stelter et al. | 355/219 |
| 5,537,198 | 7/1996 | Jackson | 355/326 R |
| 5,539,501 | 7/1996 | Yu et al. | 355/221 |
| 5,581,330 | 12/1996 | Pietrowski et al. | 355/221 |

FOREIGN PATENT DOCUMENTS 1-340663 9/1994 Japan .

*Primary Examiner*—William J. Royer
*Attorney, Agent, or Firm*—John M. Kelly

[57] ABSTRACT

Printing machines and systems which incorporate recharging stations comprised of two corona generating devices which act together to recharge a previously developed photoreceptor to a predetermined potential. The first corona generating device recharges the photoreceptor's surface to a greater absolute potential than a predetermined potential which the surface is to have after being recharged. The second corona generating device reduces the photoreceptor's surface to the potential that it is to have. The second corona generating device is comprised of a plurality of spaced apart coronodes which each can impress charges on the photoreceptor's surface. The second corona generating device receives electrical inputs and applies DC potentials to the coronodes such that adjacent coronodes have opposite polarities.

18 Claims, 4 Drawing Sheets

HYBRID DC RECHARGE METHOD AND APPARATUS FOR SPLIT RECHARGE IMAGING

FIELD OF THE INVENTION

Electrophotographic marking is a well known and commonly used method of copying original documents. Electrophotographic marking is typically performed by exposing a light image of an original document onto a substantially uniformly charged photoreceptor. In response to that light image the photoreceptor discharges so as to create an electrostatic latent image of the original document on the photoreceptor's surface. Toner particles are then deposited onto the latent image so as to form a toner powder image. That toner powder image is then transferred from the photoreceptor, either directly or after an intermediate transfer step, onto a substrate such as a sheet of paper. The transferred toner powder image is then permanently fused to the substrate using heat and/or pressure. The surface of the photoreceptor is then cleaned of residual developing material and recharged in preparation for the creation of another image.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor. Although it may be possible to achieve voltage uniformity by simply recharging previously toned layers to the same voltage level as neighboring untoned areas, an effect referred to as residual toner voltage complicates the process. Residual toner voltage is the voltage difference that occurs between toned areas which have been reexposed and discharged and untoned areas which have been exposed and discharged. The residual toner voltage reduces the effective development field in the toned areas, thereby hindering the attempt to achieve a desired uniform consistency of the developed mass of subsequent toner powder images. The problem becomes increasingly severe as additional toner powder images are exposed and developed. Color quality is threatened since the residual toner voltage can cause color shifts, increased moire effects, increased color shift sensitivity to image registration, and toner spreading at image edges. Thus, it is beneficial to reduce or eliminate the residual toner voltage.

Various solutions to the problem of residual toner voltage have been proposed. For example, a copending United States patent application entitled "Method and Apparatus for Reducing Residual Toner Voltage," Ser. No. 08/347,616 discloses a recharging method and apparatus which uses corona devices with high sloped output current (current applied to the charge retentive surface) verses photoreceptor surface voltage characteristics. However, that system's reduction in residual toner voltage is rather limited.

A recharging method which reduces photoreceptor voltage distribution nonuniformities is described in Japanese Patent application No. Hei 1-340663, Application date Dec. 29, 1989, Publication date Sep. 4, 1991, assigned to Matsushita Denki Sangyo K.K. That reference discloses a color imaging system which uses two rechargers. The first recharger applies a voltage to the photoreceptor which is higher than the voltage the photoreceptor is to have when it passes to an exposure station. The second recharger reduces the surface voltage of the photoreceptor to that which the photoreceptor is to have when it passes to the exposure station. However, patent application No. Hei 1-340663 teaches that the difference in voltage between those applied by the first and second rechargers is sufficient to insure that the polarity of all toner in the toner powder images is reversed after passing through the rechargers. The net result is a reduction in the residual charge in the toned areas and a reduction in toner spray. Toner spray is a phenomena that occurs when a photoreceptor carrying a toner image is recharged to a relatively high charge level and then exposed. In areas where the edges of prior developed images align but do not overlap with the edges of a subsequent image, the toner of the prior image tends to spray or spread into the subsequently exposed areas (which have a relatively lower charge level). Reversing the polarity of the toner prevents toner spray since the reversed polarity toner is not attracted to the exposed areas.

While the method described in Japanese Patent application No. Hei 1-340663 is effective in reducing residual toner charge and toner spray, when a composite toner powder image comprised of a substantial amount of toner is reversed in polarity, a different problem can develop. After recharging and subsequent exposure, the toner in the prior developed toner powder image has a polarity which is opposite that of both the background untoned areas and the incoming toner which is to form a toner powder image. An interaction occurs among the three distinctly charged regions. For example, in a system having a negatively charged photoreceptor and which uses discharged area development (DAD), the negatively charged toner used for development would be reversed in polarity after recharge using the teachings of Japanese Patent application No. Hei 1-340663. The positively charged toner powder layer would then be attracted to the negatively charged background areas and the incoming negatively charged toner. The positively charged toner then tends to splatter onto neighboring bare background regions. This occurrence is called the "under color splatter" defect (UCS). UCS causes unwanted blending of colors and spreading of colors from image edges onto background areas.

Copending and commonly assigned U.S. Patent application, "Split Recharge Method and Apparatus for Color Image Formation," Ser. No. 08/347,617 discloses a recharging method which attempts to solve the UCS problem. Specifically, U. S. patent application Ser. No. 08/347,617 discloses a split recharge configuration wherein a first corona generating device recharges a charge retentive surface having a developed image thereon to a higher absolute potential than a predetermined potential, and then a second corona generating device having an AC voltage supplied thereto recharges the surface to the predetermined potential. The difference in the photoreceptor surface potential after being recharged by the first corona recharge device and the second corona recharge device is called the "voltage split." Significantly, the alternating current from the second recharger substantially neutralizes the electrical charge associated with the image. U. S. patent application Ser. No. 08/347,617 also enables a reduced residual toner voltage since the toner voltage is directly proportional to the applied voltage split. However, to prevent the toner in the prior developed toner powder image from reversing polarity the amount of voltage split is limited. This limits the amount of residual toner voltage reduction that can be achieved.

Another approach to the problem of residual toner voltage is described in copending and commonly assigned U.S. Patent application Ser. No. 08/354,392 entitled, "DOUBLE SPLIT RECHARGE METHOD AND APPARATUS FOR COLOR IMAGE FORMATION." That document discloses the use of three consecutively positioned corona recharging devices in a single recharging station. The three recharging devices substantially eliminate voltage differences between toned areas and untoned areas after recharging, prevent toner polarity reversal, and substantially reduce the residual charges remaining on previously toned areas. In operation, the first corona recharging device overcharges the previously developed photoreceptor to a greater absolute potential (say −850 volts) then that desired when the photoreceptor leaves the recharging devices (say −500 volts). The second corona recharging device reduces the potential of the photoreceptor to something below that which the photoreceptor is to have when it leaves the recharging devices (to say −400 volts). Finally, the third corona recharging device adjusts the voltage of the photoreceptor to the desired voltage. In the process, the third device ensures that the toner polarity is not reversed, thus eliminating under color splatter. However, the recharging method described in U.S. patent application Ser. No. 08/354,392 requires three separate recharging devices.

Based on the foregoing, a method and apparatus which enables the recharging of developed photoreceptors to a uniform level with minimal residual toner voltage, without the undercolor splatter defect, and without large charging currents would be highly desirable.

SUMMARY OF THE INVENTION

The present invention provides for a charging station which charges a charge retentive surface to a predetermined potential. The charging station includes a first corona generating device which charges the charge retentive surface to a greater absolute potential than the predetermined potential and a second corona generating device which adjusts the charge on the charge retentive surface to the predetermined potential. The second corona generating device includes a plurality of spaced apart coronodes which each can impress charges on the charge retentive surface and electrical inputs for receiving electrical power and for applying DC potentials to the coronodes such that adjacent coronodes have different polarities and such that positive potentials are applied to positive coronodes and negative potentials are applied to negative coronodes. Beneficially, the second corona generating device includes a grid interposed between said coronodes and said charge retentive surface.

The present invention also provides for a printing machine having a charge retentive surface, an initial charging station for charging the charge retentive surface to a predetermined potential, an exposure station for exposing the charge retentive surface so as to produce a first latent images, a developing station for depositing toner on the first latent image, and a charging station for recharging the charge retentive surface to a predetermined potential. The charging station includes a first corona generating device for charging the charge retentive surface to a greater absolute potential than the predetermined potential and a second corona generating device for adjusting the charge on the charge retentive surface to the predetermined potential. The second corona generating device includes a plurality of spaced apart coronodes which each can impress charges on the charge retentive surface, and electrical inputs for receiving electrical power and for applying DC potentials to the coronodes such that adjacent coronodes have different polarities and such that positive potentials are applied to positive coronodes and negative potentials are applied to negative coronodes. Beneficially, the second corona generating device includes a grid interposed between the coronodes and the charge retentive surface to produce a scorotron.

The present invention also provides for a method of creating multiple, overlapping toner powder images. That method includes the steps of charging a charge retentive surface to a predetermined potential, exposing the charge retentive surface to produce a first electrostatic latent image, developing the first electrostatic latent image to produce a first toner powder image, charging the charge retentive surface and first toner powder image to a higher absolute potential than the predetermined potential, neutralizing the charge on the charge retentive surface to the predetermined potential by passing the charge retentive surface past a charging device which is comprised of interlaced positive and negative coronodes, exposing the charge retentive surface to produce a second electrostatic latent image, and developing the second electrostatic latent image to produce a second toner powder image.

BRIEF DESCRIPTION OF THE DRAWINGS

Other aspects of the present invention will become apparent as the following description proceeds and upon reference to the drawings, in which.

In the drawings, like numbers designate like elements.

DETAILED DESCRIPTION OF THE PREFERRED EMBODIMENTS

The described embodiments relate to imaging systems which produce image on image color outputs. It is to be understood, however, that the present invention is not limited to such embodiments. On the contrary, the present invention is intended to cover all alternatives, modifications and equivalents as may be included within the scope of the appended claims.

Figure 1:
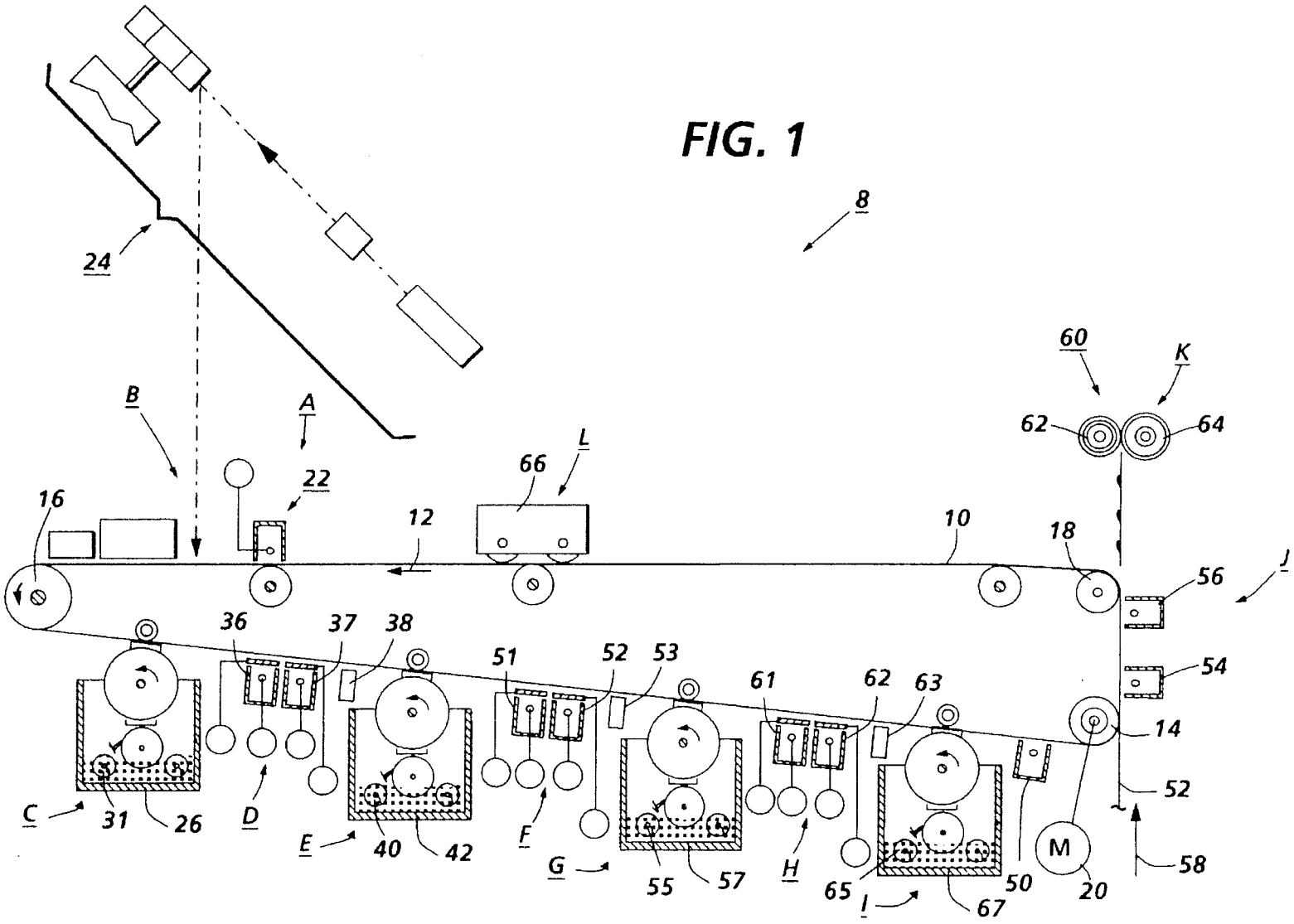
FIG. 1 is a schematic illustration of an electrophotographic printing machine which incorporates the principles of the present invention.

FIG. 1 illustrates an electrophotographic printing machine 8 which creates a color image in a single pass through the machine and which incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way a description of the typical processing of one image area suffices to fully explain the operation of the printing machine.

Figure 2A:
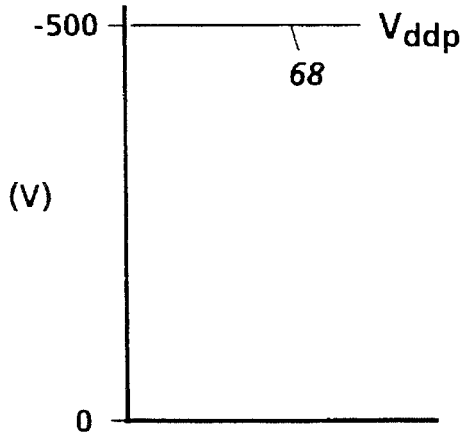
FIG. 2A shows a typical voltage profile of an image area in the electrophotographic printing machines illustrated in FIGS. 1 and 4 after that image area has been charged.

As the photoreceptor belt 10 moves, the image area passes through a charging station A. At charging station A a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
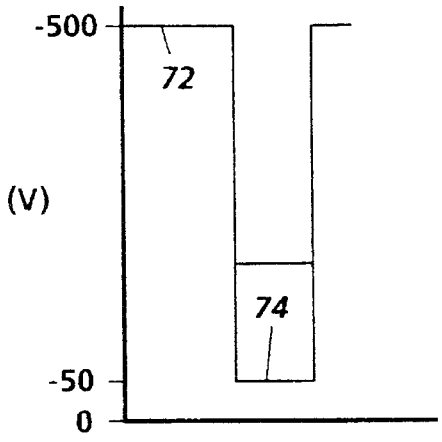
FIG. 2B shows a typical voltage profile of the image area after being exposed.

After passing through the charging station A the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C. The first development station C deposits a first color, say black, of negatively charged toner 31 onto the image area. That toner is attracted to the less negative sections of the image area and repelled by the more negative sections. The result is a first toner powder image on the image area.

While the first development station C could be a magnetic brush developer, a scavengeless developer may be somewhat better. Scavengeless development is well known and is described in U.S. Pat. No. 4,984,019 entitled, "Electrode Wire Cleaning," issued 3 Jan. 1991 to Folkins; in U.S. Pat. No. 4,868,600 entitled "Scavengeless Development Apparatus for Use in Highlight Color Imaging," issued 19 Sep. 1989 to Hayes et al.; in U.S. Pat. No. 5.010,367 entitled "Dual AC Development System for Controlling The Spacing of a Toner Cloud," issued 23 Apr. 1991 to Hays; in U.S. Pat. No. 5,253,016 entitled, "Contaminant Control for Scavengeless Development in a Xerographic Apparatus," issued on 12 Oct. 1993 to Behe et al.; and in U.S. Pat. No. 5,341,197 entitled, "Proper Charging of Doner Roll in Hybrid Development," issued to Folkins et al. on 23 Aug. 1994. Those patents are hereby incorporated by reference. One benefit of scavengeless development is that it does not disturb previously deposited toner layers. Since during the first pass through the machine 8 the image area does not have a previously developed toner layer, the use of scavengeless development at the first development station C is not required as long as the developer is physically cammed away during other passes. However, since the other development stations (described below) use scavengeless development it is beneficial to use scavengeless development at every development station.

Figure 2C:
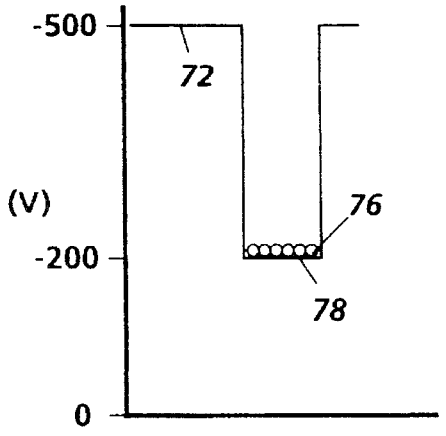
FIG. 2C shows a typical voltage profile of the image area after being developed.

FIG. 2C shows the voltages on the image area after the image area passes through the first development station C. Toner 76 (which generically represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
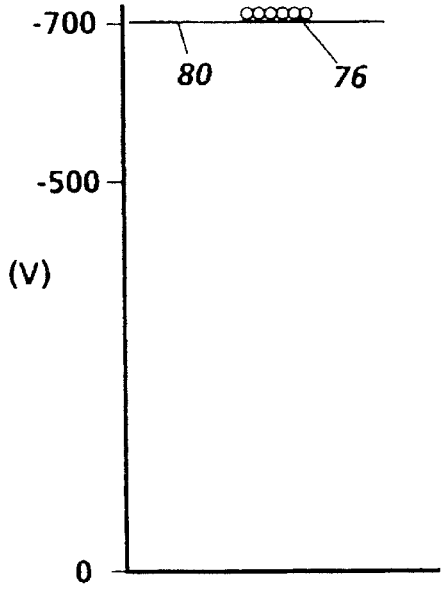
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
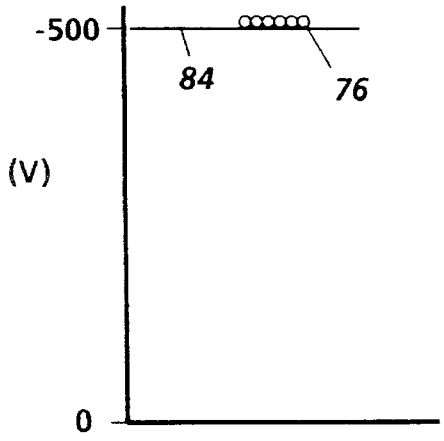
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts. Thus, the voltage split between the untoned parts of the image area is about −200 volts.

Figure 3A:
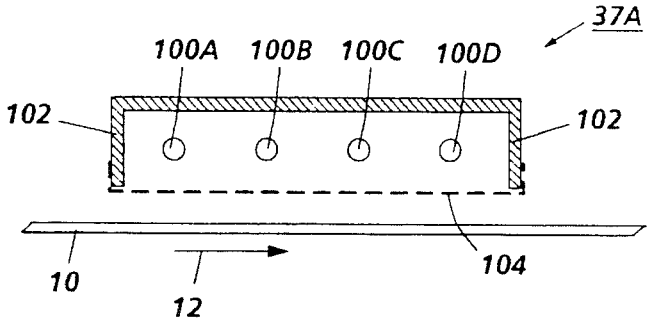
FIG. 3A schematically depicts a first embodiment of a second recharging device according to the principles of the present invention.

In accord with the present invention the second recharging device 37 can take several forms. For example, FIG. 3A illustrates a second recharging device 37A which is a scorotron comprised of a plurality of spaced apart coronodes, the coronodes 100A through 100D, a housing 102 and a grid 104. In operation, adjacent coronodes have opposite DC polarities. Beneficially, the first coronode, in FIG. 3A coronode 100A, has a positive polarity since the negatively charged image area which is to be reduced in potential moves in the direction 12. Thus, in FIG. 3A, the coronodes 100A and 100C have a positive DC polarity and the coronodes 100B and 100D have a negative polarity. Additionally, the grid 104 is biased negative, but not as negative as the image area (less negative than −700 volts). In operation a positive current flows from the coronode 100A to the image area as the image area moves in the direction 12. If the resulting surface potential of the image area becomes positive relative to the grid, the adjacent negative coronode 100B supplies negative current to the image area. As the image area progresses through the recharging device 37A the delivery of positive and negative charges occur as dictated by the surface potential of the image area relative to the grid bias. Finally, as the image area emerges from the recharging station D the charge on the image area is a the uniform level 84 shown in FIG. 2E, and the probability of toner polarity reversal is minimized.

Figure 3B:
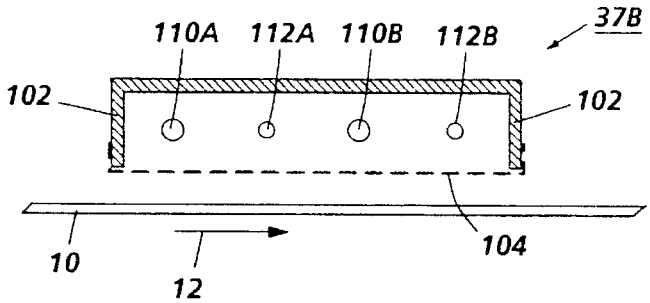
FIG. 3B schematically depicts a second embodiment of a second recharging device according to the principles of the present invention.

While the second recharging device 37A shown in FIG. 3A is beneficial, another second recharging device in accord with the present invention, the second recharging device 37B, shown in FIG. 3B, may be preferred in some applications. The second recharging device 37B is a scorotron having a plurality of spaced apart positive coronodes, the coronodes 110A and 110B, a plurality of spaced apart negative coronodes, the coronodes 112A and 112B, a housing 102 and a grid 104. The operation of the second recharging device 37B is the same as the second recharging device 37A shown in FIG. 3A. However, to take advantageous of the benefits known in the prior art of having relatively large positive coronodes and relatively small negative coronodes, the positive coronodes 110A and 110B are physically larger than the negative coronodes 112A and 112B.

Figure 3C:
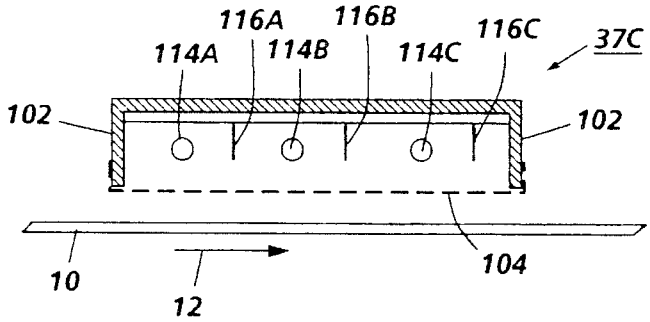
FIG. 3C schematically depicts a third embodiment of a second recharging device according to the principles of the present invention.

Another second recharging device in accord with the principles of the present invention, the second recharging device 37C, is shown in FIG. 3C. The second recharging device 37C is a hybrid scorotron comprised of a plurality of spaced apart positive coronodes, the wire coronodes 114A, 114B, and 114C, and a plurality of spaced apart negative pin coronodes, the pin coronodes 116A, 116B, and 116C, a housing 102 and a grid 104. The operation of the second recharging device 37C is the same as the second recharging devices 37A and 37B. However, the second recharging device 37C takes advantage of the benefits known in the prior art of using pin coronodes for supplying negative charges.

Figure 3D:
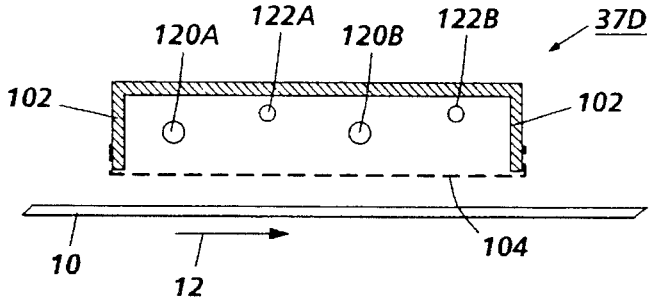
FIG. 3D schematically depicts a third embodiment of a second recharging device according to the principles of the present invention.

Yet another second recharging device in accord with the principles of the present invention, the second recharging device 37D, is shown in FIG. 3D. The second recharging device 37D is a scorotron having a plurality of spaced apart positive coronodes, the coronodes 120A and 120B, and a plurality of spaced apart negative coronodes, the coronodes 122A and 122B, a housing 102 and a grid 104. The operation of the second recharging device 37D is the same as the second recharging devices 37A, 37B, and 37C. However, the second recharging device 37D has negative coronodes which are offset in different planes than the positive coronodes.

As shown by the second recharging devices illustrated in FIGS. 3A through 3D, many second recharging device 37 which are in accord with the principles of the present invention are possible. Indeed modifications of more than the coronodes are also possible. For example, in some applications it may be desirable to apply positive voltages to the first two coronodes and then begin alternating negatively charged coronodes. Likewise, in some applications it may be beneficial to make the last two coronodes negatively biased.

Figure 2F:
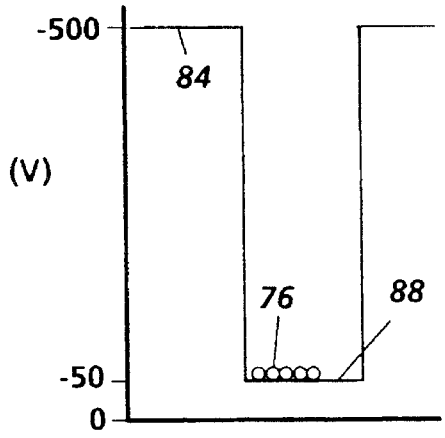
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having alternating potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

If black toners are developed first as described above, than one of the two corona recharge devices 36 and 37 could be eliminated. This is so because color toner is not usually developed over black toner. Additionally, the printing machine 8 was described as having a charging station A which charges the image area after cleaning. While charging station A could use a single corotron, scorotron, or dicorotron, in some application it might be beneficial to use the same charging devices as in the recharging stations D, F, and H.

Figure 4:
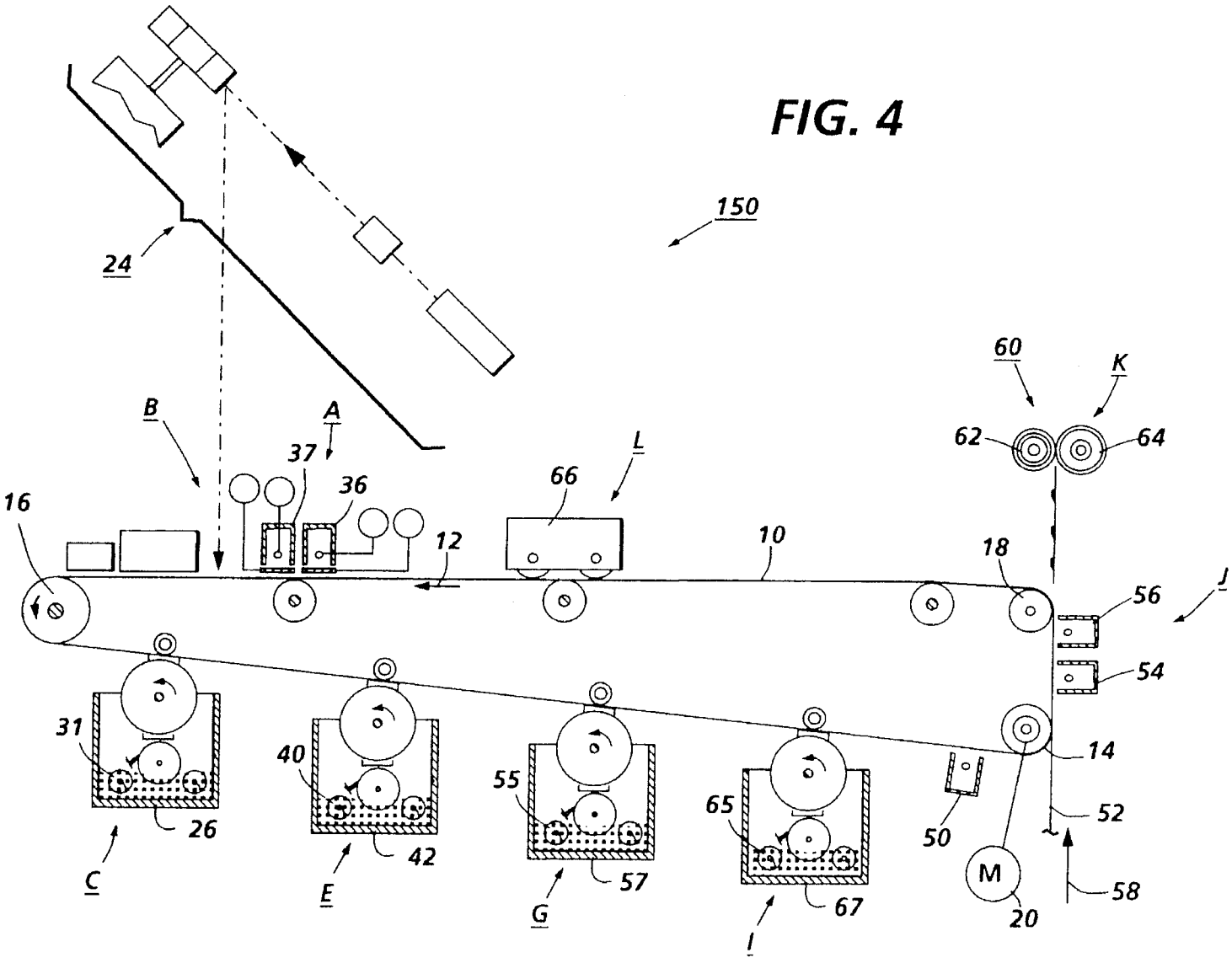
FIG. 4 is a schematic illustration of another electrophotographic printing machine which incorporates the features of the present invention.

FIG. 4 illustrates an electrophotographic printing machine 150 which is also in accord with the principles of the present invention. The printing machine 150 creates a color image by passing an image area four times through the machine, one pass for each color toner.

As in the printing machine 8, the printing machine 150 uses a charge retentive surface in the form of an Active Matrix (AMAT) photoreceptor belt 10 which travels sequentially through various xerographic process stations in the direction indicated by the arrow 12. Again, belt travel is brought about by mounting the belt about a drive roller 14 and two tension rollers 16 and 18 and then rotating the drive roller 14 via a drive motor 20.

The marking process of the electrophotographic printing machine 150 begins with the image area passing through a charging station A. The charging station A includes two corona charging devices, a first charging device 36 and a second charging device 37. When the image area is being initially charged only one of the charging devices, say the charging device 36, needs to be used. FIG. 2A shows the voltage profile 68 on the image area after it passes through charging station A for the first time. Again, the image area has a uniform potential of about −500 volts. In practice, this is accomplished by charging the image area slightly more negative than −500 volts so that any resulting dark decay reduces the voltage to the desired −500 volts.

After passing the charging station A for the first time the charged image area passes an exposure station B. At exposure station B, the image area is exposed to the output of a laser based output scanning device 24 (or other type of light source such as an LED printbar) which illuminates the image area with a light representation of an image. During this first pass through the exposure station B the image area is exposed to create an electrostatic latent image of a first color, say black. FIG. 2B shows typical voltage levels, the levels 72 and 74, which might exist on the image area after exposure. After exposure, the image area has a voltage profile comprised of high and low voltages.

After passing the exposure station B for the first time the image area passes through a first development station C which deposits a first toner powder image of a first color, black, on the image area. As in the printing machine 8, the first development station C beneficially uses a scavengeless developer 26, which advances negatively charged toner 31 onto the image area. FIG. 2C shows the voltages on the image area after the image area passes through the first development station C.

After passing through the first development station C the image area advances so as to return to the charging station A for recharging. As was previously mentioned the charging station A is comprised of two corona charging devices, a first charging device 36 and a second charging device 37. While only one of the charging devices was needed to initially charge the image area, during recharging the charging devices work together to recharge the voltage levels of both the toned and untoned parts of the image area to a substantially uniform level.

FIG. 2D shows the voltages on the image area after it passes the first charging device 36. As shown, the first charging device overcharges the image area to more negative levels than that which the image area is to have when it leaves the charging station A. For example, as shown in FIG. 2D the toned and the untoned parts of the image area reach a voltage level 80 of about −700 volts. The first charging device 36 is preferably a DC scorotron.

After being charged by the first charging device 36, the image area passes to the second charging device 37. As shown in FIG. 2E, the second charging device 37 reduces the voltage of the image area, both the untoned parts and the toned parts (represented by toner 76), to a level 84, the desired potential of about −500 volts. Thus, the voltage split between the untoned parts of the image area is about −200 volts. The second charging device 37 can take many forms. For example, those shown in FIGS. 3A through 3D and as described in more detail above.

After being recharged at charging station A, the now substantially uniformly charged image area with its first toner powder image again passes the exposure station B. The exposure station illuminates the image area with a light representation of a second color image (say yellow) so as to create a second electrostatic latent image. FIG. 2F illustrates the potentials on the image area after it passes through the exposure station the second time. The image area then advances to a second development station E which deposits a second toner powder image of a second color, yellow, on the image area. The second development station E, which should use a scavengeless developer 42, advances negatively charged toner 40 onto the image area.

The image area then advances again to charging station A for recharging. The substantially uniformly charged image area with its two toner powder images then again passes the exposure station B. The exposure station B then illuminates the image area with a light representation of a third color image (say magenta) so as to create a third electrostatic latent image. The image area then advances to a third development station G which deposits a third toner powder image of a third color, magenta, on the image area. The third development station G, which also includes a scavengeless developer 57, advances negatively charged magenta toner 55 onto the image area.

Once again the image area advances to charging station A for recharging. The charging station A again recharges the image area in the same manner as it did previously. The substantially uniformly charged image area with its three toner powder images then again passes the exposure station B. The exposure station B then illuminates the image area with a light representation of a fourth color image (say cyan) so as to create a fourth electrostatic latent image.

The image area then advances to a fourth development station I which deposits a fourth toner powder image of a fourth color, cyan, on the image area. The fourth development station I which also includes a scavengeless developer 67, advances negatively charged cyan toner 65 onto the image area.

After the fourth toner powder image is developed the composite toner powder image is ready for transfer to the a support sheet 52. The transfer of the composite toner powder image to the support sheet is accomplished in the same manner described above in relation to the printing machine 8.

After the composite toner powder image is transferred to the support sheet 52, the photoreceptor belt 10 is cleaned of residual toner particles at cleaning station L via a cleaning brush contained in a housing 66. The image area is then ready to begin a new marking cycle.

While the foregoing descriptions were directed to full color printing machines, it will be appreciated that the principles of the present invention may also be used in other types of marking machines, specifically including highlight color processing machines.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A charging station for charging a charge retentive surface to a predetermined potential, said charging station comprising:

a first corona generating device for charging a charge retentive surface to a greater absolute potential than a predetermined potential; and a second corona generating device for charging the charge retentive surface to adjust the charge thereon to said predetermined potential, said second corona generating device including a plurality of spaced apart coronodes which each can impress charges on the charge retentive surface, and electrical inputs for receiving electrical power and for applying DC potentials to said coronodes such that at least two adjacent coronodes have different polarities and such that positive potentials are applied to positive coronodes and negative potentials are applied to negative coronodes.

2. The charging station according to claim 1, wherein said second corona generating device includes a grid spaced between said coronodes and said charge retentive surface, said grid for regulating the charge transferred from said coronodes to said charge retentive surface.

3. The charging station according to claim 2, wherein said coronodes having negative polarities are spaced a further distance from said grid than said coronodes having positive polarities.

4. The charging station according to claim 1, wherein said coronodes having negative polarities are physically smaller than said coronodes having positive polarities.

5. The charging station according to claim 1, wherein said coronodes having negative polarities are pin coronodes.

6. The charging station according to claim 1, wherein said first corona generating device supplies a direct current to the charge retentive surface.

7. The charging station according to claim 1, wherein said charge retentive surface has a polarity which remains constant as said second corona generating device charges the charge retentive surface from said greater absolute potential to said predetermined potential.

8. A printing machine, comprising:

a charge retentive surface;

a charging station for charging said charge retentive surface to a predetermined potential;

a first exposure station for exposing said charge retentive surface to produce a first latent image on said charge retentive surface; and a first developing station for depositing toner on said first latent image so as to produce a first toner powder image on said charge retentive surface;

wherein said charging station includes a first corona generating device for charging the charge retentive surface to a greater absolute potential than the predetermined potential, said charging station further includes a second corona generating device for charging the charge retentive surface to adjust the charge thereon to said predetermined potential, said second corona generating device having a plurality of spaced apart coronodes which each can impress charges on the charge retentive surface, and electrical inputs for receiving electrical power and for applying DC potentials to said coronodes such that at least two adjacent coronodes have different polarities and such that positive potentials are applied to positive coronodes and negative potentials are applied to negative coronodes.

9. The printing machine according to claim 8 wherein said second corona generating device includes a grid spaced between said coronodes and said charge retentive surface, said grid for regulating the charge transferred from said coronodes to said charge retentive surface.

10. The printing machine according to claim 9, wherein said coronodes having negative polarities are spaced a further distance from said grid than said coronodes having positive polarities.

11. The printing machine according to claim 8, wherein said coronodes having negative polarities are physically smaller than said coronodes having positive polarities.

12. The printing machine according to claim 8, wherein said coronodes having negative polarities are pin coronodes.

13. The printing machine according to claim 8, wherein said first corona generating device supplies a direct current to the charge retentive surface.

14. The printing machine according to claim 8, wherein said charge retentive surface has a polarity which remains constant as said second corona generating device charges the charge retentive surface from said greater absolute potential to said predetermined potential.

15. The printing machine according to claim 8, further including:

a second exposure station for exposing said charge retentive surface to produce a second latent images on said charge retentive surface, and second developing station for depositing toner onto said second latent image so as to produce a second toner powder image on said charge retentive surface.

16. A method of creating multiple toner powder images, comprising:

(a) charging a charge retentive surface to a predetermined potential;

(b) exposing the charge retentive surface so as to produce a first electrostatic latent image;

(c) developing the first electrostatic latent image to produce a first toner powder image;

(d) charging the charge retentive surface and first toner powder image to a higher absolute potential than the predetermined potential;

(e) neutralizing the charge on the charge retentive surface to the predetermined potential by passing the charge retentive surface past a charging device which is comprised of interlaced positive and negative coronodes;

(f) exposing the charge retentive surface to produce a second electrostatic latent image; and (g) developing the second electrostatic latent image to produce a second toner powder image.

17. The method according to claim 16 wherein the first and second toner powder images are of different colors.

18. The method according to claim 17 wherein the first and second toner powder images overlap one another.

* * * * *